US008837962B2

(12) United States Patent
Peng et al.

(10) Patent No.: US 8,837,962 B2
(45) Date of Patent: Sep. 16, 2014

(54) IMAGE FORMING APPARATUS WITH FUNCTION FOR CORRECTING DEVIATION OF IMAGE FORMING POSITION

(75) Inventors: Youbao Peng, Hino (JP); Tadashi Matsudaira, Hachioji (JP); Akihiro Hayashi, Okazaki (JP); Satoshi Ogata, Hachioji (JP); Eiji Nishikawa, Tachikawa (JP); Takashi Nara, Kawagoe (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 344 days.

(21) Appl. No.: 13/020,927

(22) Filed: Feb. 4, 2011

(65) Prior Publication Data

US 2011/0194860 A1 Aug. 11, 2011

(30) Foreign Application Priority Data

Feb. 9, 2010 (JP) ..... 2010-026151

(51) Int. Cl.
*G03G 15/00* (2006.01)

(52) U.S. Cl.
CPC .. *G03G 15/6558* (2013.01); *G03G 2215/00721* (2013.01); *G03G 15/5062* (2013.01)
USPC ..... 399/49; 399/72

(58) Field of Classification Search
USPC ..... 399/15, 16, 49, 72, 301
See application file for complete search history.

(56) References Cited

U.S. PATENT DOCUMENTS 6,452,147 B1 9/2002 Inada

FOREIGN PATENT DOCUMENTS

| | | | |
|---|---|---|---|
| JP | 62040470 A | * | 2/1987 |
| JP | 10-009426 | | 8/1999 |
| JP | 2000258972 A | * | 9/2000 |
| JP | 2000-008771 | | 7/2001 |
| JP | 2006025359 A | * | 1/2006 |
| JP | 2005-055721 | | 9/2006 |
| JP | 2007-218577 | | 3/2009 |
| JP | 2009-128885 | | 6/2009 |

OTHER PUBLICATIONS

Notice of Reasons for Refusal issued Jun. 4, 2013 by Japan Patent Office in corresponding Japanese Patent Application No. JP 2010-026151 (4 pages).
English-language translation of Notice of Reasons for Refusal issued Jun. 4, 2013 by Japan Patent Office in corresponding Japanese Patent Application No. JP 2010-026151 (5 pages).
Final Rejection issued Oct. 4, 2013 by Japan Patent Office in corresponding Japanese Patent Application No. JP 2010-026151 (3 pages).
English-language translation of Final Rejection issued Oct. 4, 2013 by Japan Patent Office in corresponding Japanese Patent Application No. JP 2010-026151 (4 pages).

* cited by examiner

*Primary Examiner* — Erika J Villaluna
(74) *Attorney, Agent, or Firm* — Buchanan Ingersoll & Rooney PC

(57) ABSTRACT

When an input image is to be formed on a sheet conveyed to a transfer roller, the exposure section is controlled and deviation correction is performed to offset the image forming position across the width of the sheet in response to the result of detection by a deviation sensor. By contrast, when pattern images are to be formed on a sheet in response to the instruction of the main control section, the image forming control section does not perform deviation correction in the process of forming a pattern image.

12 Claims, 9 Drawing Sheets

IMAGE FORMING APPARATUS WITH FUNCTION FOR CORRECTING DEVIATION OF IMAGE FORMING POSITION

This application is based on Japanese Patent Application No. 2010-026151 filed on Feb. 9, 2010 with Japanese Patent Office, the entire content of which is hereby incorporated by reference.

BACKGROUND OF THE INVENTION

The present invention relates to an image forming apparatus.

The products known in the conventional art includes image forming apparatuses using electrophotographic process or inkjet process such as printers and multi-functional peripherals. In the image forming apparatus of this type, stability and uniformity of image quality are required. For example, in the color image forming apparatus using electrophotographic process, the color of the formed image is subject to change in conformity to changes in the environment or long-term use. For example, the Japanese Unexamined Patent Application Publication No. 2009-128885 discloses an image forming apparatus provided with a color sensor for detecting the color of the toner image subsequent to fixing operation. This image forming apparatus is equipped with an image forming section for forming a pattern image on a sheet, a pair of color sensors installed symmetrically with respect to the centerline of the sheet, which is parallel to the conveying direction, and a control section for controlling the density of the toner image according to the readings by a pair of color sensors. In this case, the image forming section forms a pattern image on the sheet positionally corresponding to the range read by one of the color sensors, but not on the sheet positionally corresponding to the range read by the other. Based on the difference of readings by a pair of color sensors, the control section controls the density of the toner image formed on the sheet.

Further, to minimize the misalignment of the image for each sheet in conformity to the misalignment (displacement in the direction perpendicular to the sheet conveyance direction) of the sheet being conveyed, and the misalignment of the image on the both sides of one sheet, the image forming apparatus uses a technique of correcting the image forming position by an image forming section (deviation correction).

Incidentally, because of the performance of the deviation correction, the image forming position of the pattern image is also corrected by the aforementioned deviation correction according to the displacement of the sheet. In this case, the positions of the pattern image detection sensor and pattern image on the sheet will be displaced, and the pattern image cannot be accurately detected by the sensor.

In view of the problems described above, it is one of the objects of the present invention to ensure accurate detection of a pattern image while minimizing the image misalignment by deviation correction.

SUMMARY

To achieve at least one of the aforementioned objects, an image forming apparatus reflecting one aspect of the present invention includes the following.

The first embodiment of the invention includes an image forming section for forming an image on a sheet which is conveyed; an image control section for controlling the image forming section for forming an input image corresponding to image data having been inputted or a pattern image corresponding to pattern data stored in advance; a conveyance position detecting section for detecting a conveyance position of the sheet across a width of the sheet perpendicular to a sheet conveyance direction before the image is formed on the sheet by the image forming section; an image detecting section for detecting the pattern image formed on the sheet by the image forming section and an instructing section which gives an instruction to the image control section to form the pattern image at an image forming position which is located at a position corresponding to a position of the image detecting section across the width of the sheet, and which has been set in advance. In this case, when forming the input image on the sheet having been conveyed to the image forming section, the image control section controls the image forming section so as to perform a deviation correction to change the image forming position across the width of the sheet, according to a result of detection by the conveyance position detecting section, and when forming the pattern image on the sheet according to the instruction from the instructing section, the image control section controls so as not to perform the deviation correction for formation of the pattern image.

The second embodiment of the invention includes an image forming section for forming an image on a sheet which is conveyed; an image control section for controlling the image forming section for forming an input image corresponding to image data having been inputted or a pattern image corresponding to pattern data stored in advance; a conveyance position detecting section for detecting a conveyance position of the sheet across a width of the sheet perpendicular to a sheet conveyance direction before the image is formed on the sheet by the image forming section; and an instructing section which gives an instruction to the image control section to form the pattern image at an image forming position which is located at a position corresponding to a position of an image detecting section for detecting the pattern image, across the width of the sheet, and which has been set in advance. In this case, when forming the input image on the sheet having been conveyed to the image forming section, the image control section controls the image forming section so as to perform a deviation correction to change the image forming position across the width of the sheet, according to a result of detection by the conveyance position detecting section, and when forming the pattern image on the sheet according to the instruction from the instructing section, the image control section controls so as not to perform the deviation correction for formation of the pattern image.

DETAILED DESCRIPTION OF THE PREFERRED EMBODIMENT

Figure 1:
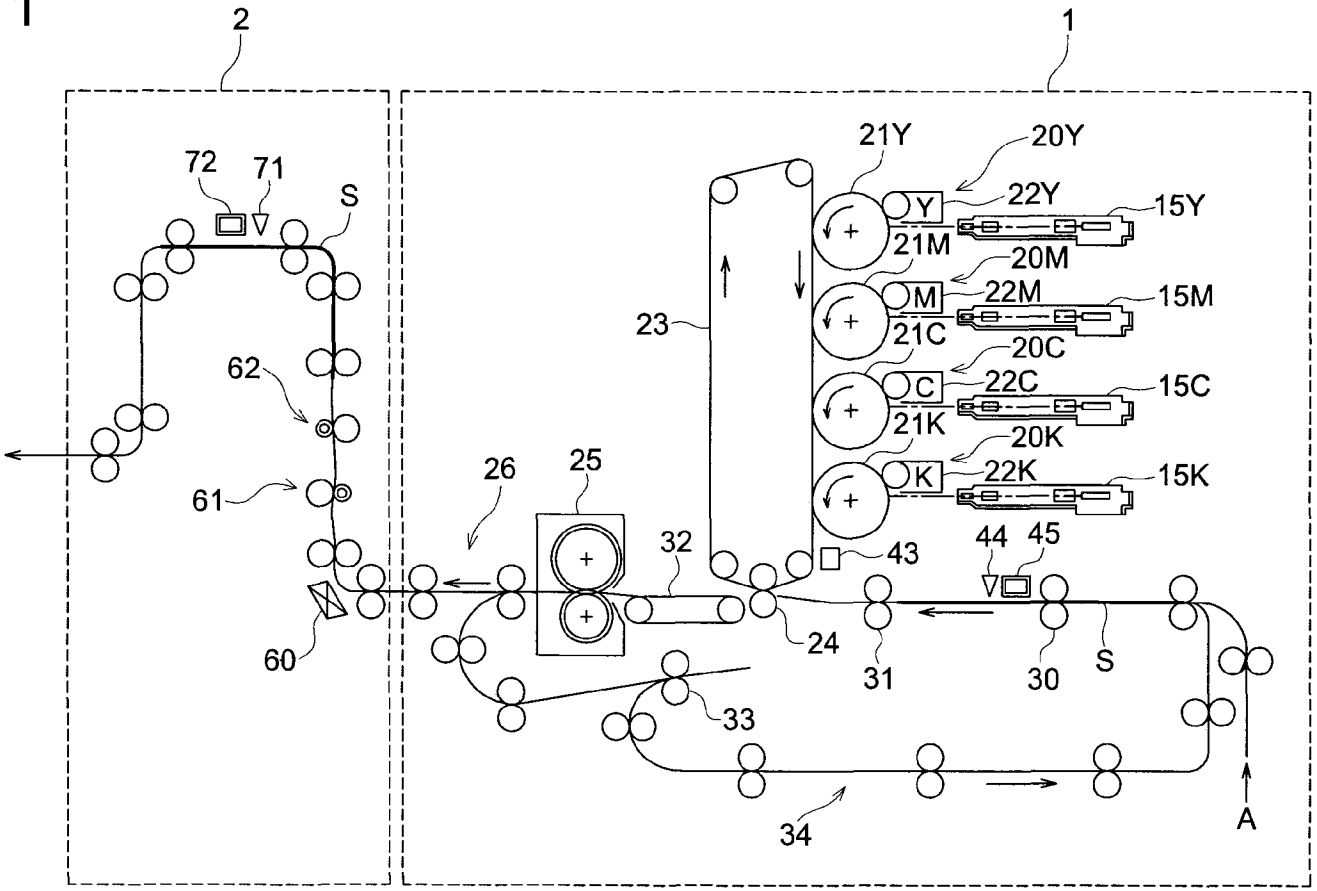
FIG. 1 is an explanatory diagram schematically representing the configuration of an image forming apparatus.

Other embodiments will be described as follows.

In the second embodiment of the invention, it is preferred that the image forming apparatus includes a sheet conveying device for conveying a sheet having an image formed thereon by the image forming section, the sheet conveying device being a unit independent from a body unit which includes at least the image forming section. In this case, it is preferred that sheet conveying device includes the image detecting section for detecting the pattern image formed on the sheet in a conveyance path of the sheet and the image forming position for the pattern image across the width of the sheet has been set in advance such that the image forming position corresponds to the position of the image detecting section when the sheet is conveyed to the image detecting section along the conveyance path.

In the first or second embodiment of the invention, it is preferred that when not performing the deviation correction, the image control section does not offset the image forming position, independently of the result of detection by the conveyance position detecting section. Alternatively, it is preferred that when not performing the deviation correction, the image control section does not permit the conveyance position detecting section to detect the conveyance position for the sheet as a target of formation of the pattern image.

In the first or second embodiment of the invention, the image forming apparatus can be further provided with a condition correcting section for correcting an image forming condition by the image forming section. Here, it is preferred that the pattern image is a multiple tone pattern image in which an image density changes step by step in the conveyance direction of the sheet. In this case, it is preferred that the image detecting section detects a density of the image formed on the sheet and the condition correcting section corrects an image density condition of the image forming section based on a result of detection of the pattern image by the image detecting section.

In the first or second embodiment of the invention, the image forming section can be made up of a plurality of image forming units for forming a color image by superimposition of images of different colors. In this case, it is preferred that the pattern image includes a plurality of pattern images of different colors across the width of the sheet because each of the plurality of image forming units forms one pattern image at a different position from another. Further, the image detecting section includes a plurality of image detecting units each of which corresponds to each of the image forming units.

In this case, the plurality of image detecting units are preferably arranged close to one another across the width of the sheet such that the plurality of pattern images having different colors can be formed even on a sheet of a prescribed small size out of a plurality of sizes of sheets on which the image forming section can form an image.

Next, further detailed embodiments will be described.

Figure 2:
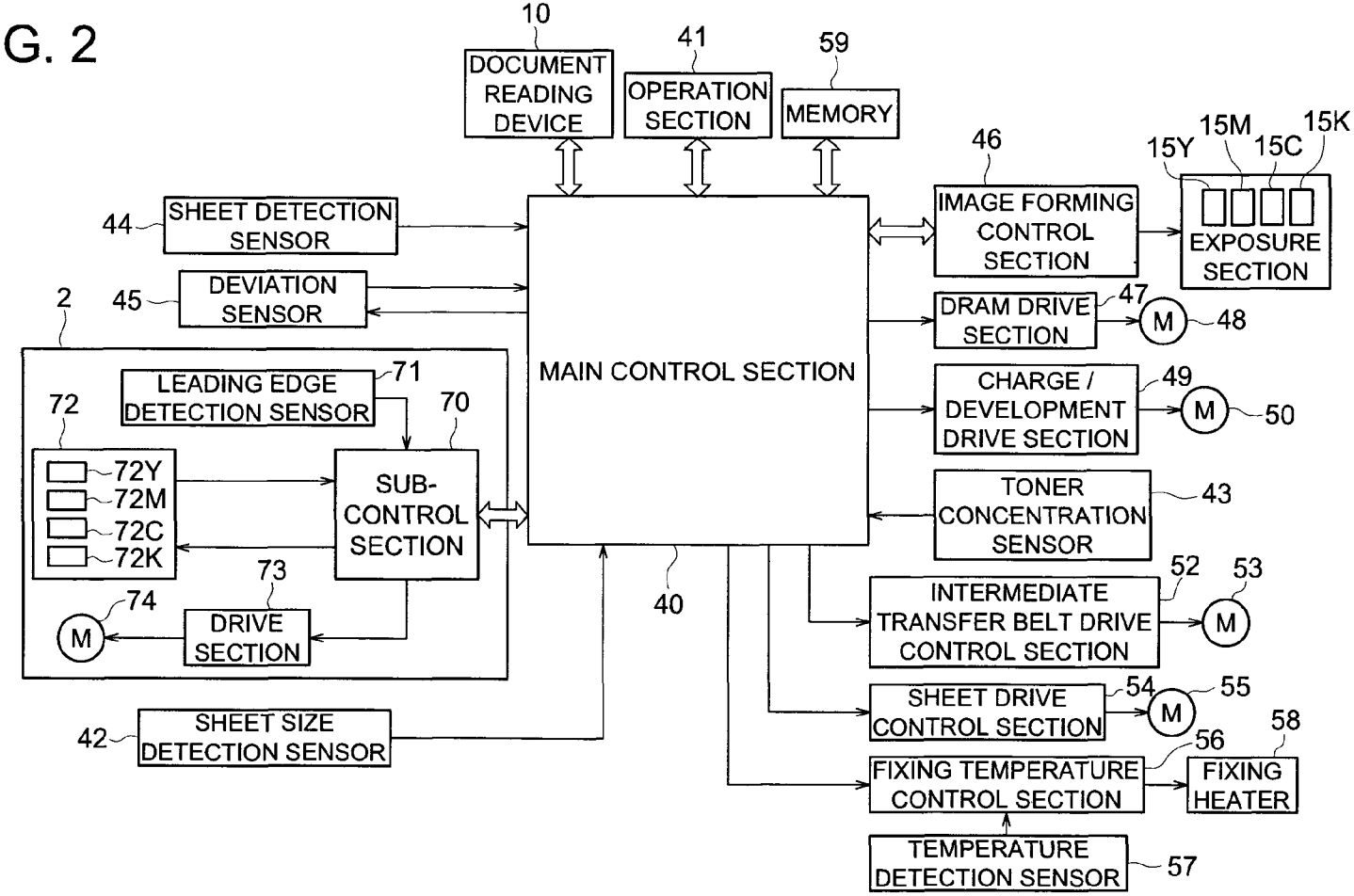
FIG. 2 is a block diagram functionally representing the configuration of an image forming apparatus.

FIG. 1 is an explanatory diagram schematically representing the configuration of an image forming apparatus in an embodiment of the present invention. FIG. 2 is a block diagram functionally representing the configuration of an image forming apparatus of FIG. 1. The image forming apparatus is an image forming apparatus using electrophotographic process such as a photocopier, for example. To put it more specifically, this image forming apparatus is a so-called tandem type color image forming apparatus in which a plurality of photoreceptors are arranged to face one intermediate transfer belt and are laid out in a longitudinal array, whereby a full-color image is formed. This image forming apparatus is provided with a body unit 1 for forming an image on a sheet S, and a relay unit 2 for conveying the sheet S ejected from the body unit 1 and for feeding it to a post-processing apparatus (not illustrated). In the present embodiment, the body unit 1 and relay unit 2 are designed in a structure independent of each other.

The major components of the body unit 1 include a document reading device 10 (not illustrated in FIG. 1), exposure sections 15Y, 15M, 15C, 15K, charge/development units 20Y, 20M, 20C and 20K, intermediate transfer belt 23, fixing section 25, main control section 40 (not illustrated in FIG. 1), which are incorporated in one housing.

The document reading device 10 is an automatic document feeder (not illustrated) mounted on the upper portion of the body unit. The document reading device 10 reads the image of the document being conveyed, and applies image processing to the image signal having been obtained. To put it more specifically, the document reading device 10 uses a lamp to apply light to the image of the document. The reflected light is used to form an image on the light receiving surface of the image pick-up element. The incoming light is subjected to photoelectric conversion, and a prescribed image signal is outputted by the image pick-up element. The document reading device 10 applies such processing as analog-to-digital conversion, shading correction and compression to the image signal. The signal subsequent to the processing is outputted to the main control section 40 as image data. The image data (hereinafter referred to as "input image data") inputted into the main control section 40 is not restricted to the data read by the document reading device 10. For example, this data can be the data received from a personal computer connected to the body unit 1 or from other image forming apparatus.

Each of the exposure sections 15Y through 15K is composed of a laser light source, polygon mirror, a plurality of lenses. In response to the output image data generated by the image forming control section 46 to be described later, each of the exposure sections 15Y through 15K applies laser beams to the surfaces of the photoreceptor drums 21Y, 21M, 21C and 21K to perform scanning and exposure operations.

The major components of the charge/development unit 20Y include the photoreceptor drum 21Y and the charge/development section 22Y arranged on the periphery thereof. A toner image corresponding to yellow is formed on the photoreceptor drum 21Y. The remaining charge/development units 20M, 20C and 20K also have the same configuration as that of the charge/development unit 20Y. The charge/development sections 22M, 22C and 22K are arranged around the photoreceptor drums 21M, 21C and 21K, respectively. The toner images corresponding to magenta, cyan and black are formed on the photoreceptor drums 21M, 21C and 21K, respectively.

The surfaces of the photoreceptor drums 21Y through 21K are uniformly charged by the charge/development sections 22Y through 22K. A latent image is formed on each of the photoreceptor drums 21Y through 21K by scanning and exposure by the aforementioned exposure sections 15Y through 15K. Further, the charge/development sections 22Y through 22K ensures the latent images on the photoreceptor drums 21Y through 21K to be developed through development with the toner. This allows a toner image to be formed on each of the photoreceptor drums 21Y through 21K. The toner images formed on the photoreceptor drums 21Y through 21K are sequentially transferred to prescribed positions on the intermediate transfer belt 23.

In the meantime, as indicated by arrow mark A, sheets S are supplied from a sheet storage tray (not illustrated) and are conveyed to the transfer roller 24 through the sheet feed roller 30 and registration roller 31 installed along the sheet conveyance path. The transfer roller 24 ensures that the toner image having been transferred onto the intermediate transfer belt 23 is transferred to the sheet S having been fed, at time determined by the registration roller 31.

In the present embodiment, the exposure sections 15Y through 15K, charge/development unit 20Y through 20K, intermediate transfer belt 23 and transfer roller 24 constitute the image forming section. To be more specific, the image forming section has a function of forming toner images on the sheets S having been conveyed, through a series of processes of (1) charging the photoreceptor drums 21Y through 21K; (2) allowing electrostatic latent images to be formed on the photoreceptor drums 21Y through 21K by the exposure sections 15Y through 15K; (3) ensuring that toner is attached to the formed electrostatic latent image; (4) permitting the toner images on the photoreceptor drums 21Y through 21K to be primarily transferred onto the intermediate transfer belt 23; and (5) enabling the toner image on the intermediate transfer belt 23 to be secondarily transferred onto the sheet S.

The sheet S carrying a toner image is fed to the fixing section 25 through the conveying belt 32. The fixing section 25 fixes the toner image on the sheet S by applying pressure and heat to the sheet S.

Provided with a sheet ejection roller and guide member (not illustrated), the ejection section 26 conveys the sheet S having been subjected to the process of fixing by the fixing section 25, and ejects the sheet S to the relay unit 2. When an image is to be formed on the reverse side of the sheet S as well, the ejection section 26 uses the guide member to send the sheet S having been subjected to the process of fixing the toner image of the surface, to the reversing roller 33 located below. After sandwiching the trailing end of the sheet S, the reversing roller 33 feeds the sheet S in the reverse direction, whereby the sheet S is reversed and is fed out to the sheet re-feed conveyance path 34.

The main control section 40 is exemplified by a CPU. The main control section 40 has a function of integral administration of the body unit 1 by controlling each section of the body unit 1. To control the body unit 1, the main control section 40 receives various forms of signal input from the sub-control section 70 of the relay unit 2 (to be described later), document reading device 10, operation section 41, sheet size detection sensor 42, toner concentration sensor 43, sheet detection sensor 44 and deviation sensor 45.

The relay unit 2 outputs the result of detection by the image detecting section 72 (to be described later) to the main control section 40 through the sub-control section 70. The document reading device 10 outputs the image data read from the document, as the input image data to the main control section 40. The operation section 41 is, for example, a touch panel that permits an input operation to be performed according to the instruction displayed on the display. The operation section 41 ensures that the printing conditions (e.g., the type of the sheet, image density and magnification rate) set through the input operation by the user is outputted to the main control section 40.

The sheet size detection sensor 42 is mounted on the sheet storage tray for stacking and storing the sheet, and is used to detect the size of the stored sheet. The toner concentration sensor 43 detects the density of the toner image transferred onto the intermediate transfer belt 23. In the sheet conveyance path where the sheet S is fed to the image forming section (i.e., transfer roller 24), the sheet detection sensor 44 detects that the sheet S being conveyed has reached the sensor position thereof. This sheet detection sensor 44 is arranged near the deviation sensor 45 (to be described later) on the sheet S conveyance path.

The deviation sensor 45 is installed on the sheet conveyance path along which the sheet S is conveyed to the image forming section (i.e., transfer roller 24). Before the image is formed on the sheet S by the transfer roller 24, this deviation sensor 45 detects, the sheet S conveyance position in the direction perpendicular to the sheet conveyance direction (hereinafter referred to as "across the width of the sheet"), specifically, the edge position of the sheet S (conveyance position detecting section). Normally, the image forming apparatus is designed in such a way that, in the conveyance of the sheet S, the center position of the sheet S across the width of the sheet (hereinafter referred to as "sheet center position") corresponds to a prescribed position of the sheet conveyance path, for example, the center position across the width of the sheet (hereinafter referred to as "conveyance reference position"). Here, the standard state of the sheet S indicates that the sheet center position corresponds to the conveyance reference position. Further, the sheet S is deviated if there is no correspondence between the sheet center position and conveyance reference position. The deviation sensor 45 detects the distance from the conveyance reference position to the edge of the sheet S (e.g., edge on the left side with reference to sheet conveyance direction), whereby the edge position of the sheet S is detected. For example, a contact imager sensor (CIS) can be used as the deviation sensor 45.

Based on these signals, the main control section 40 outputs various forms of control signal to the sub-control section 70 of the relay unit 2, image forming control section 46, drum drive section 47, development drive section 49, intermediate transfer belt drive control section 52, sheet drive control section 54 and fixing temperature control section 56. Further, the main control section 40 stores the input image data in the memory 59 and calls the input image data from the memory 59. Based on the image density conditions, the main control section 40 generates the output image data from the input image data. To ensure that the density of the image formed on the sheet S corresponds to the density of the image regulated by the input image data stored in the memory 59, as an image density condition, the operating state of the image forming section (i.e., amount of exposure by exposure sections 15Y through 15K) is defined. The image density conditions representing the relationship between the amount of exposure and density is stored in the memory 59, and the main control section 40 refers to the image density conditions as required.

Based on the output image data outputted from the main control section 40, the image forming control section 46 controls the image forming section (i.e., exposure sections 15Y through 15K). This allows the image forming control section 46 to form an image on the sheet S conveyed to the image forming section (transfer roller 24) in conformance to the output image data (image control section).

Further, in the present embodiment, the main control section 40 as an instructing section performs control to correct the image forming conditions, for example, when there is a user instruction through the operation section 41 or the number of image formations has reached a prescribed number. This control is started when the main control section 40 has issued a prescribed execution instructions to the image forming control section 46 and sub-control section 70 (instructing section). Here, the image forming conditions denote the operation conditions for the image forming section to form an image on the sheet S. In the present embodiment, the image density conditions correspond to this.

In one of the characteristics of the present embodiment, upon receipt of a deviation correction instruction from the main control section 40, the image forming control section 46 updates the time to start writing the output image data, based on this deviation correction instruction. To be more specific, image forming control section 46 controls the image forming section (i.e., exposure sections 15Y through 15K) in conformance to the deviation correction instruction. This allows the image forming position across the width of the sheet (i.e., exposure position for photoreceptor drums 21Y through 21K) to be changed from the original image forming position determined by the input image data in conformity to the result of detection by the deviation sensor 45 (deviation correction).

Figure 3:
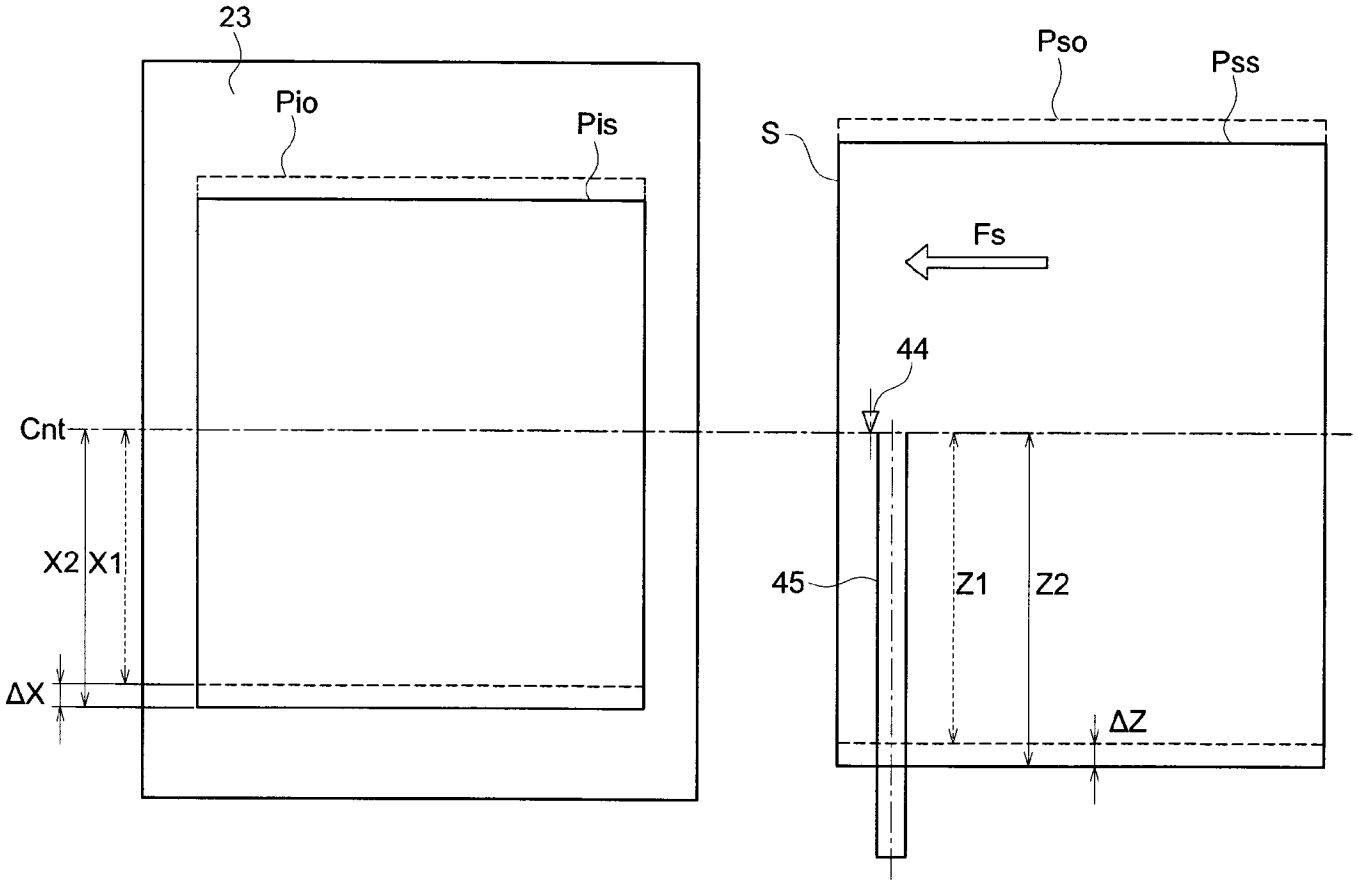
FIG. 3 is an explanatory diagram representing the concept of deviation correction.

FIG. 3 is an explanatory diagram representing the concept of deviation correction. In FIG. 3, the arrow mark Fs indicates the sheet S conveying direction. The image forming section is controlled by the image forming control section 46 on the assumption that the center position of the sheet S to be conveyed corresponds to the conveyance reference position Cnt, as described above. Thus, if the sheet S being conveyed is off-centered, the image to be formed at the originally prescribed position on the sheet S is formed at the position displaced from the prescribed position in conformity to the deviation level of the sheet S. For example, the deviation amount ΔZ of the sheet S is given as the difference between the edge position Z1 and edge position Z2 (ΔZ=Z1−Z2), if the edge position in the standard state of the sheet S (hereinafter referred to as "standard edge position") is "Z1" as shown in the sheet position Pso, and the edge position of the sheet S actually conveyed (hereinafter referred to as "actual edge position") is "Z2". The edge position Z1 can be specified as the distance between the sheet center position and the edge of the sheet S if the size of the sheet S to be conveyed has been specified.

Thus, the main control section 40 calculates the deviation amount ΔZ of the sheet S based on the result of detection by the deviation sensor 45. This calculation value (deviation amount ΔZ) as a deviation correction instruction is outputted to the image forming control section 46. In response to this deviation amount ΔZ, the image forming control section 46 calculates the correction values for the starting time of writing in the exposure sections 15Y through 15K. For the sheet S in the standard state, the toner image on the intermediate transfer belt 23 is formed in the region Pio, for example. In the meantime, when the sheet S is deviated by the deviation amount ΔZ, the exposure positions on the photoreceptor drums 21Y through 21K by the exposure sections 15Y through 15K are corrected by deviation correction (correction of the time to start writing in the exposure sections 15Y through 15K). This allows the position to be changed by the deviation amount ΔZ of the sheet S with reference to the exposure position which is not corrected. The toner image on the intermediate transfer belt 23 is formed on the region Pis. For the image formed in the region Pio, it is assumed that the distance between the conveyance reference position Cnt and the edge of the toner image is X1. Further, for the image formed in the region Pis, it is assumed that the distance between the conveyance reference position Cnt and the edge of the toner image is X2. In this case, the deviation amount ΔX of the toner image is equal to the difference between distances X1 and X2. This value corresponds to the deviation amount ΔZ of the sheet S. As described above, this deviation correction ensures that the image forming position across the width of the sheet with reference to the conveyance reference position Cnt is offset in conformity to the deviation amount ΔZ of the sheet S. This minimizes image misalignment for each sheet and image misalignment on the obverse and reverse sides of one sheet.

In the meantime, when execution instructions for correction of the image density conditions have been outputted, the main control section 40 outputs the output image data corresponding to the pattern image (hereinafter referred to as "pattern data") to the image forming control section 46. The image forming control section 46 forms an image on the sheet S conveyed to the image forming section (transfer roller 24) in conformity to the pattern data. This enables the pattern image to be formed on the sheet S. For example, if the pattern data is stored in the memory 59 in advance, the data can be read out of the memory 59 by the main control section 40. If the execution instructions on the correction of the image density conditions are outputted from the main control section 40, the image forming control section 46 does not execute the deviation correction. To put it another way, when a pattern image is to be formed on the sheet S, the image forming control section 46 does not apply a process of deviation correction to the sheet S.

Based on the result of detection by the image detecting section 72 outputted from the relay unit 2, namely, based on the result of detection by the image detecting section 72 regarding the sheet S with a pattern image formed thereon, the main control section 40 corrects the image density conditions (condition correcting section). To ensure that the density of the image to be formed on the sheet S corresponds to that of the image defined by the image data, the image density conditions can be corrected by feedback control by this correction.

Based on the control signal from the main control section 40, the drum drive section 47 drives the motor unit 48 including one or more motors, thereby controlling the rotating operation of each of the photoreceptor drums 21Y through 21K. The charge/development drive section 49 drives the motor unit 50 and others based on the signal coming from the main control section 40, thereby controlling each of the charge/development sections 22Y through 22K. The intermediate transfer belt drive control section 52 drives the motor unit 53 based on the signal coming from the main control section 40, thereby controlling the operation of the intermediate transfer belt 23. The sheet drive control section 54 controls the motor unit 55, thereby controlling the rotating operation of the rollers used to convey the sheets, including the sheet feed roller 30, registration roller 31, conveying belt 32 and reversing roller 33. Based on the signal from the main control section 40, the fixing temperature control section 56 controls the fixing heater 58 provided in the fixing section 25, thereby controlling the temperature of the fixing section 25 in the process of heating and fixing. This fixing temperature control section 56 is supplied with the detection signal of the temperature detection sensor 57 for detecting the temperature of the fixing section 25. The fixing temperature control section 56 can control the temperature of the fixing section 25 by feedback.

Referring to FIG. 1 and FIG. 2 again, the relay unit 2 is a unit for further feeding the sheet S with the image formed thereon, to the post-processing apparatus (not illustrated) located on the post-stage of the image forming apparatus. This relay unit 2 also has a function of cooling the sheet S subsequent to the process of heating and fixing and correcting the curl formed on the sheet S in the step of conveying the sheet S in the unit. This unit also has a function of detecting the density of the pattern image. The major components of the relay unit 2 include a cooler 60, a pair of curl correcting sections 61 and 62, and sub-control section 70 (not illustrated in FIG. 1). The internal sheet conveyance path is composed of a number of conveying rollers and guide members.

The cooler 60 is made of a cooling fan, for example, and cools the sheet S being conveyed, by blowing air to the conveyed sheet S.

The first curl correcting section 61 corrects the upper curl, namely, the curl with a peak formed at the central portion. The second curl correcting section 62 corrects the lower curl, namely the curl with a valley formed at the central portion. The major components of each of the curl correcting sections 61 and 62 include a small-diameter roller and a large-diameter roller having a diameter larger than the small-diameter roller. When the sheet S passes through the curl correcting sections 61 and 62, the sheet S is subjected to the bending force of the small-diameter roller and large-diameter roller, and the curl is corrected. The sheet P curled is corrected to the flat form by a pair of curl correcting sections 61 and 62.

The sub-control section 70 is a CPU, for example. It has a function of controlling each portion of the relay unit 2, thereby providing integral administration of the relay unit 2. The sub-control section 70 are supplied with various forms of signals from the main control section 40 of the body unit 1, leading edge detection sensor 71 and image detecting section 72.

The main control section 40 outputs the execution instructions related to the correction of the image density conditions to the sub-control section 70. The leading edge detection sensor 71 detects that the sheet S being conveyed has reached the sensor position thereof in the sheet S conveyance path of the relay unit 2. This leading edge detection sensor 71 is installed upstream of the image detecting section 72 (to be described later) on the sheet S conveyance path.

Figure 4:
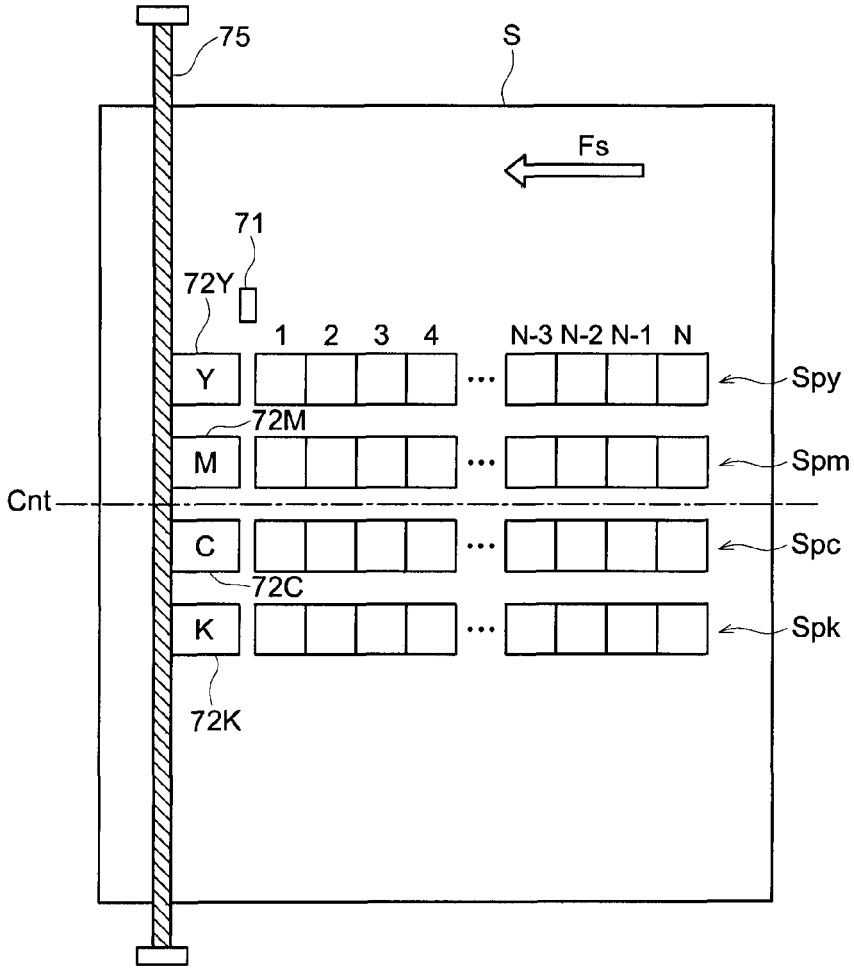
FIG. 4 is an explanatory diagram representing an image detecting section 72 and pattern image.

FIG. 4 is an explanatory diagram representing an image detecting section 72 and pattern image. The image detecting section 72 detects the pattern image formed on the sheet S, in the sheet S conveyance path of the relay unit 2, thereby determining the density of this image (image detecting section). This image detecting section 72 is mounted on the support member 75 extending across the width of the sheet above the sheet conveyance path, is composed of four color sensors 72Y, 72M, 72C and 72K corresponding to yellow, magenta, cyan and black, respectively.

In this case, the pattern image formed on the sheet S is made up of four single-color pattern images Spy, Spill, Spc and Spk corresponding to yellow, magenta, cyan and black. Each of pattern images Spy through Spk is configured in such a way that the image density undergoes a multi-stage change (monochromatic multiple tone pattern image). To put it more specifically, this pattern image is formed of four pattern images Spy through Spk having different colors across the width of the sheet and different levels of tone in the sheet conveyance direction when each of the charge/development units 20Y through 20K has formed one pattern image at mutually different positions. In each of the pattern images Spy through Spk, the image forming position across the width of the sheet is preset in advance to ensure that, when the sheet S is conveyed to the image detecting section 72 along the sheet conveyance path, positional correspondence with the respective color sensor 72Y through 72K will be established. To put it another way, in each of the pattern images Spy through Spk, the image forming position across the width of the sheet is preset in advance with reference to the region through which the sheet S passes along the sheet conveyance path, on the assumption that, when the sheet S is conveyed to the image detecting section, the positions of the image forming and the sensors correspond to each other. For the sake of illustration in the diagram, the 1st through N-th images in each of the pattern images Spy through Spk in FIG. 4 are shown to have the same level of density. However, in actual practice, the 1st through N-th images in each of pattern images Spy through Spk are gradually increased in the image density.

In the present embodiment, the color sensors 72Y through 72K are arranged close to one another around the conveyance reference position Cnt. This layout allows four pattern images Spy through Spk to be formed even on the sheet S of a prescribed smaller size (e.g., B5 size) out of the sheets on which an image can be formed in the image forming apparatus. This eliminates the need of using the sheet S of larger size to form a pattern image, and hence provides an economic advantage. Further, the relay unit 2 can be used in combination with various types of body unit 1. This body unit 1 has variations in the maximum size of the applicable sheet according to the type thereof, but is almost standardized for smaller sheet sizes. Thus, because four pattern images Spy through Spk can be formed even on a small-sized sheet, the relay unit 2 can be applied to various types of body units 1, whereby the versatility is enhanced.

Figure 5:
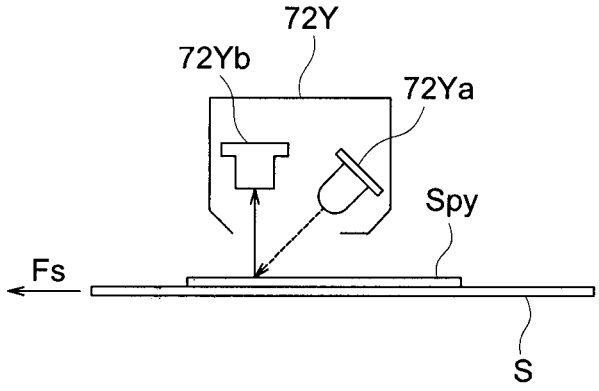
FIG. 5 is an explanatory diagram schematically representing the configuration of a color sensor 72Y.

FIG. 5 is an explanatory diagram schematically representing the configuration of a color sensor 72Y. The color sensor 72Y is made up of a light emitting element 72Y*a* such as an LED, and a light receiving element 72Y*b*. It is a sensor to detect the sheet S being conveyed, in other words, to detect the image formed on the sheet S. To be more specific, this sensor is designed to detect the density of the pattern image Spy. The drive voltage is applied to this color sensor 72Y from the sub-control section 70. This sensor is operated in response to the on/off control signal supplied from the sub-control section 70. Other color sensors 72M through 72K have the same configuration as that of the color sensor 72Y, although not illustrated.

Based on these signals, the sub-control section 70 outputs various types of control signals to the drive section 73, leading edge detection sensor 71 and image detecting section 72. Based on the control signals from the sub-control section 70, the drive section 73 drives the motor unit 74, thereby controlling the rotating operation of the conveying roller and curl correcting sections 61 and 62.

Figure 6:
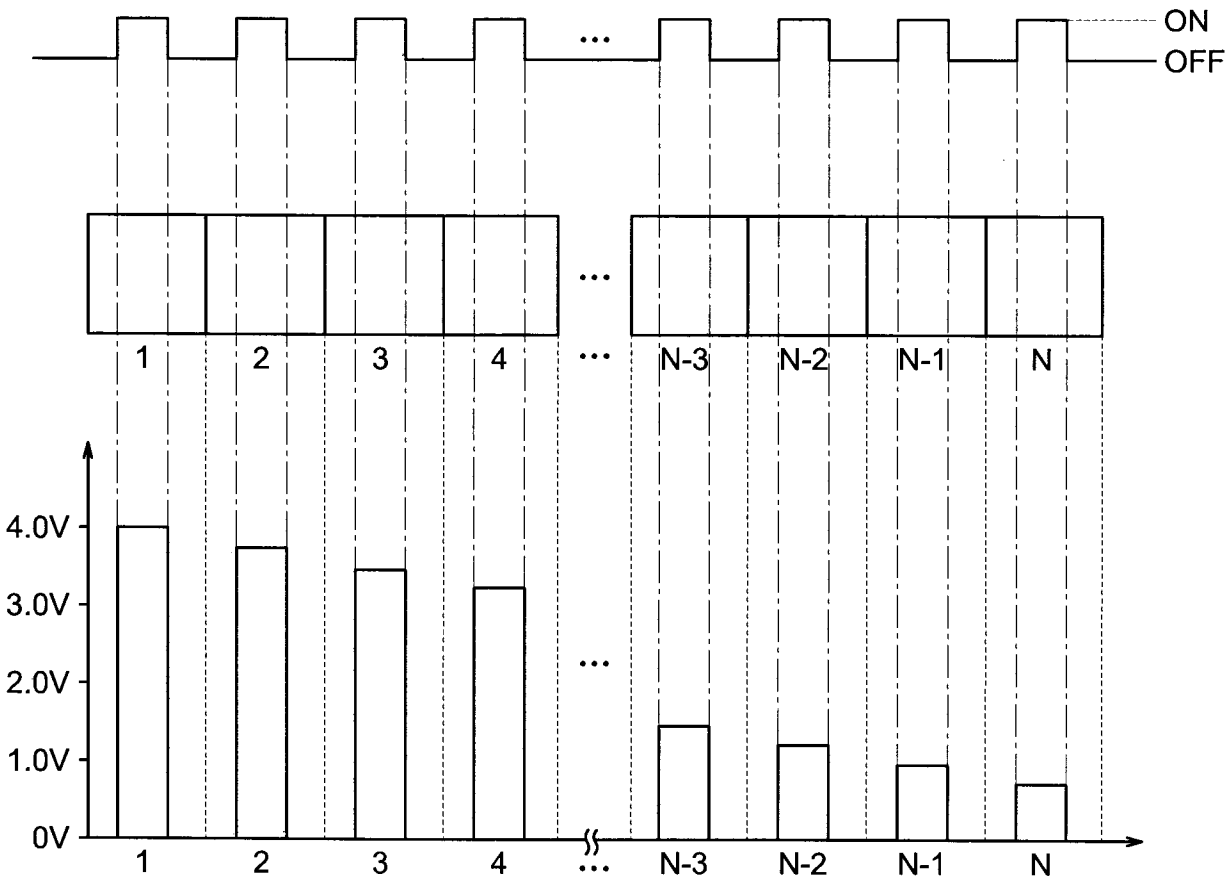
FIG. 6 is an explanatory diagram representing the detection of an image density by color sensors 72Y through 72K.

Having acquired the execution instructions on the correction of image density conditions from the main control section 40, the sub-control section 70 provides on/off control of the image detecting section 72 at prescribed time, if the passage of the sheet S has been detected by the leading edge detection sensor 71 (pattern image detection control). To put it more specifically, as shown in FIG. 6, the sub-control section 70 controls each of the color sensors 72Y through 72K to ON mode on an intermittent basis in synchronization with time when each region indicated by "1st" through "N-th" reaches the image detecting section 72. In synchronization with each ON mode period, the sub-control section 70 is supplied with the result of detection by each of the color sensors 72Y through 72K, namely the density of each region constituting the pattern images Spy through Spk, to be more specific, the voltage value in conformity to the amount of received light.

Figure 7:
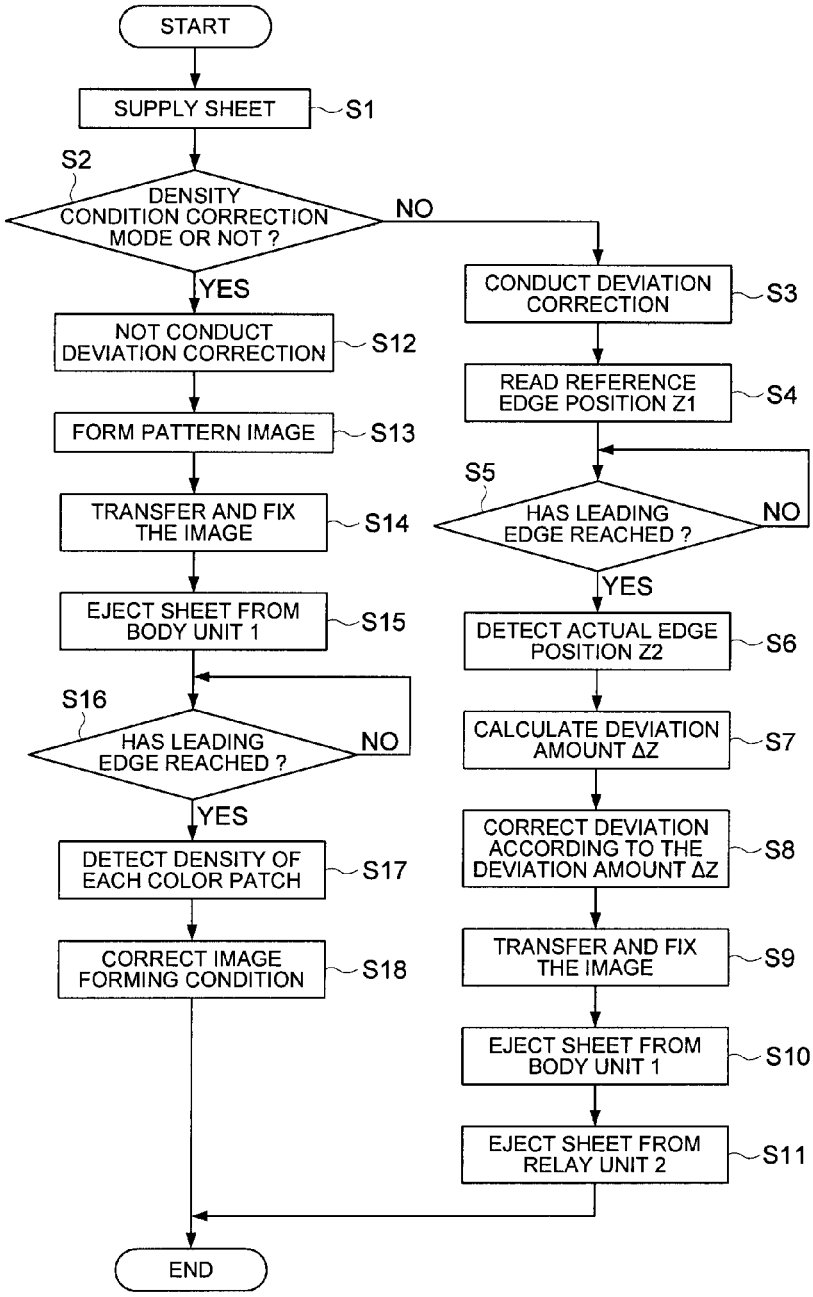
FIG. 7 is a flow chart representing the control procedure of the image forming apparatus.

Referring to FIG. 7, the following describes the control procedure of the image forming apparatus in the present embodiment. In Step 1 (S1), when an image is formed on the sheet S, the main control section 40 controls the sheet drive control section 54, whereby the sheet S is supplied from the sheet storage tray.

In Step 2 (S2), the main control section 40 determines if the operation mode for the sheet S having been supplied is the density condition correction mode or not. This density condition correction mode is intended to control correction of the image density conditions through the detection of the pattern image by the color sensors 72Y through 72K constituting the image detecting section 72. If there is no user instruction through the operation section 41, or if the number of image formations has not yet reached a prescribed number, a negative decision will be made by the main control section 40 in Step 2. Thus, the operation proceeds to Step 3 (S3). In the meantime, if there is a user instruction through the operation section 41 or if the number of image formations has reached a prescribed number, an affirmative decision will be made by the main control section 40 in Step 2. Thus, the operation proceeds to Step 12 (S12), as will be described later.

In Step 3, to perform deviation correction, the main control section 40 sends the control signals to that effect to the sub-control section 70. Upon receipt of this control signal, the sub-control section 70 turns off the power source of the leading edge detection sensor 71. The detection by the image detecting section 72 is triggered by the detection of the sheet S by the leading edge detection sensor 71. If this power source is turned off, the detection by the image detecting section 72 is suspended.

In Step 4 (S4), based on the result of detection by the sheet size detection sensor 42, the main control section 40 reads the standard edge position Z1. For example, when the table showing the correspondence between the sheet size and standard edge position Z1 is stored in the memory 59, the main control section 40 reads the standard edge position Z1 through this table.

In Step 5 (S5), the main control section 40 monitors the result of detection by the sheet detection sensor 44, and determines if the leading edge of the supplied sheet S has reached the sheet detection sensor 44 or not. If the determination is affirmative in this Step 5, i.e., if the leading edge of the sheet S has reached the sheet detection sensor 44, the operation proceeds to Step 6 (S6). In the meantime, if the determination is negative in this Step 5, i.e., if the leading edge of the sheet S has not yet reached the sheet detection sensor 44, the main control section 40 again determines if the leading edge of the sheet S has reached the sheet detection sensor 44 or not.

In Step 6, the main control section 40 turns on the power source of the deviation sensor 45, and detects the actual edge position Z2 of the sheet S being conveyed.

In Step 7 (S7), the main control section 40 subtracts the standard edge position Z1 from the actual edge position Z2, thereby calculating the deviation amount ΔZ of the sheet S. The deviation amount ΔZ having been obtained is outputted to the image forming control section 46 as a deviation correction instruction.

In Step 8 (S8), the image forming control section 46 provides image forming control in conformity to the deviation amount ΔZ. To put it more specifically, when executing exposure based on the output image data corresponding to the document image (input image), the image forming control section 46 changes the starting time of writing by the exposure sections 15Y through 15K in conformity to the deviation amount ΔZ (deviation correction). Thus, as described above with reference to FIG. 3, the toner image on the intermediate transfer belt 23 is formed at a position misaligned by the amount ΔX conforming to the deviation amount ΔZ.

In Step 9 (S9), the main control section 40 controls the intermediate transfer belt drive control section 52, sheet drive control section 54 and others. The toner image transferred onto the intermediate transfer belt 23 is transferred to the sheet S and the toner image is fixed onto the sheet S by the fixing section 25.

In Step 10 (S10), the main control section 40 controls the sheet drive control section 54. This allows the sheet S with an image formed thereon to be ejected to the relay unit 2 from the ejection section 26.

In Step 11 (S11), the sub-control section 70 controls the rotating operations of the curl correcting sections 61 and 62 by controlling the drive section 73. At the same time, the sub-control section 70 controls the rotating operation of the conveying roller. This allows the curl correction to be performed while the sheet S is conveyed. After that, the sheet S is ejected from the relay unit 2.

By contrast, if an affirmative decision has been made in Step 2 in such a way that the current mode is the density condition correction mode, the main control section 40 does not execute the deviation correction in Step S12. There can be the following two techniques not to allow the deviation correction to be performed. Any one of these techniques can be selected. In the first technique, similarly to execution of the deviation correction, the actual edge position Z2 of the sheet S is detected by a deviation sensor 45. However, independently of the result of this detection, the processing from the aforementioned Step 4 to Step 8 is not performed. To be more specific, independently of the result of this detection by the deviation sensor 45, the image forming position on the sheet S is not offset. Thus, the process of substantial deviation correction is not performed in the first technique. In the second technique, even if the arrival of the sheet S has been detected by the sheet detection sensor 44, the deviation sensor 45 is kept at the OFF mode, whereby the detection by the sensor 45 is kept suspended. In this case, the result of detection from the deviation sensor 45, i.e., the actual edge position Z2 being not obtained makes it possible to set up the mode where the deviation correction is not performed.

In Step 13 (S13), the main control section 40 gives an instruction to the image forming control section 46 to form a pattern image, based on the pattern data stored in the memory 59. Based on the pattern data, the image forming control section 46 controls the exposure sections 15Y through 15K, whereby a pattern image (toner image) in conformity to the pattern data is formed on the intermediate transfer belt 23.

In Step 14 (S14), the main control section 40 controls the intermediate transfer belt drive control section 52, sheet drive control section 54 and others. Thus, the toner image transferred on the intermediate transfer belt 23 is further transferred to the sheet S. The pattern image (toner image) is fixed onto the sheet S by the fixing section 25.

In Step 15 (S15), the main control section 40 controls the sheet drive control section 54 in such a way that the sheet S with a pattern image formed thereon is ejected to the relay unit 2 from the ejection section 26.

In Step 16 (S16), the sub-control section 70 monitors the result of detection by the leading edge detection sensor 71, and determines whether the leading edge of the conveyed sheet S has reached the leading edge detection sensor 71 or not. If an affirmative decision has been made in Step 16, that is, if the leading edge of the sheet S has reached the leading edge detection sensor 71, the operation proceeds to Step 17 (S17). In the meantime, if a negative decision has been made in Step 16, that is, if the leading edge of the sheet S has not yet reached the leading edge detection sensor 71, the operation proceeds to Step 17 (S17), the sub-control section 70 again determines if the leading edge of the sheet S has reached the leading edge detection sensor 71 or not.

In Step 17 (S17), the sub-control section 70 refers to FIG. 6, and provides pattern image detection control, as described above, thereby detecting the image density of each of the pattern images Spy through Spk. Then the sub-control section 70 outputs the result of detecting the image density of each of the pattern images Spy through Spk to the main control section 40.

In Step 18 (S18), the main control section 40 corrects the image density conditions, based on the image density of each of the pattern images Spy through Spk outputted from the sub-control section 70.

As described above, according to the present embodiment, when an input image corresponding to the input image data is to be formed on the sheet S conveyed to the image forming section (i.e., transfer roller 24), the image forming control section 46 controls the image forming section (i.e., exposure sections 15Y through 15K), thereby performing the deviation correction in such a way that the image forming position across the width of the sheet is offset in conformity to the result of detection by the deviation sensor 45. By contrast, when the pattern images Spy through Spk corresponding to the pattern data are to be formed on the sheet S in conformity to the instruction from the main control section 40, the image forming control section 46 does not perform deviation correction when pattern images are formed.

Figure 8:
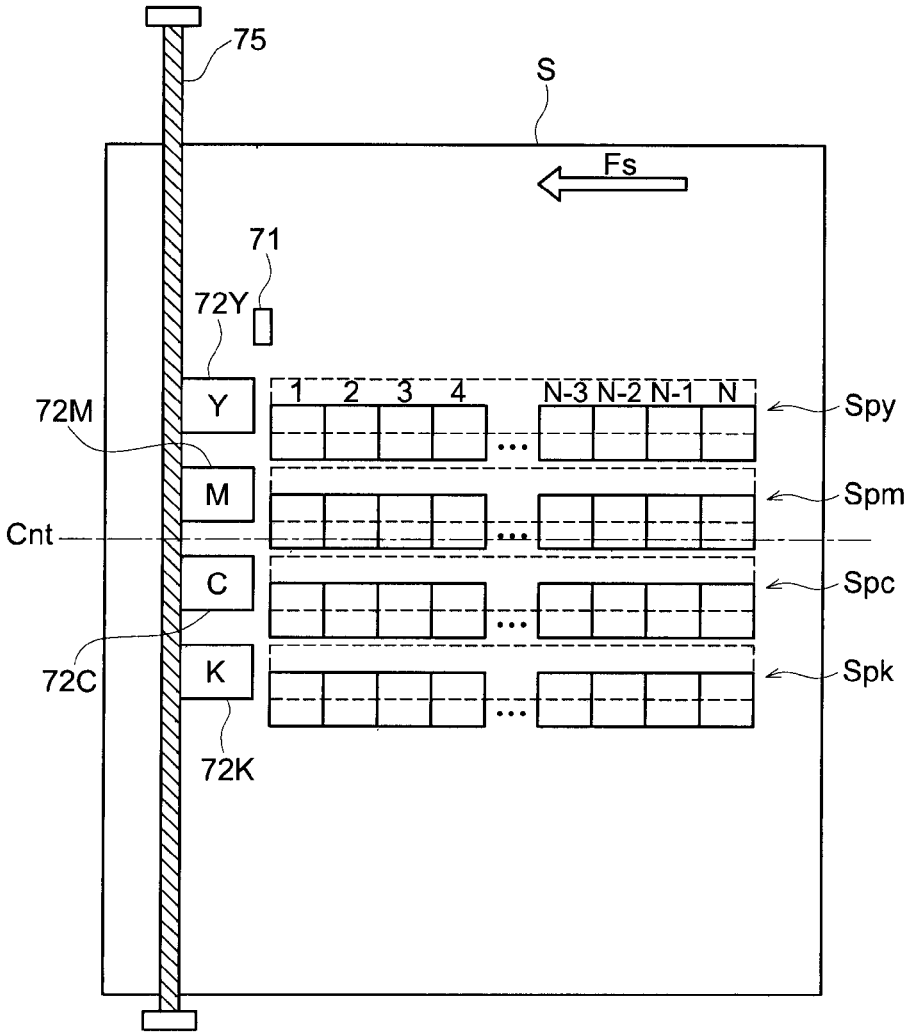
FIG. 8 is an explanatory diagram representing the positional relationship between each of pattern images Spy through Spk and each of color sensors 72Y through 72K when deviation correction is performed.
Figure 9:
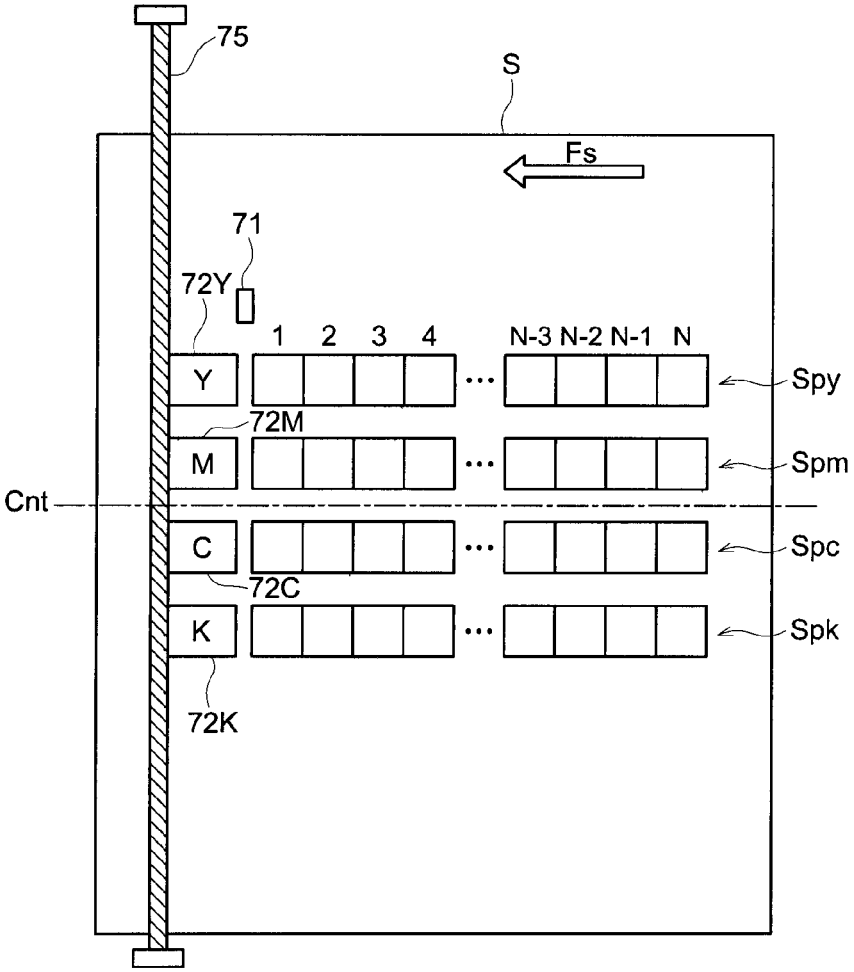
FIG. 9 is an explanatory diagram representing the positional relationship between each of pattern images Spy through Spk and each of color sensors 72Y through 72K when deviation correction is not performed.

For each of the pattern images Spy through Spk, when the sheet S is conveyed to the image detecting section 72 along sheet conveyance path, the image forming position across the width of the sheet is preset to establish positional correspondence with each of the color sensors 72Y through 72K of the image detecting section 72. Thus, as shown in FIG. 8, if the sheet S is deviated and deviation correction is performed, the image forming position of each of the pattern images Spy through Spk will be offset. This may result in positional misalignment between pattern images Spy through Spk and color sensors 72Y through 72K, with the result that accurate detection of each of the pattern images Spy through Spk cannot be achieved by each of the color sensors 72Y through 72K.

By contrast, according to the present embodiment, deviation correction is not performed by the image forming control section 46 when pattern images Spy through Spk are to be formed on the sheet S in conformity to the instruction from the main control section 40. Thus, even if the sheet S is deviated, the image forming position of each of the pattern images Spy through Spk is not offset. This ensures positional correspondence between the pattern images Spy through Spk and color sensors 72Y through 72K, and hence effective detection of each of pattern images Spy through Spk by each of the color sensors 72Y through 72K, thereby providing accurate feedback of the states of the pattern images Spy through Spk and accurate correction of the image density conditions.

Further, in the present embodiment, the image forming apparatus is a unit independent of the body unit 1 including at least an image forming section. The image forming apparatus further includes a relay unit 2 for conveying the sheet S with an image formed thereon by the image forming section, to an external device (e.g., a post-processing apparatus). The relay unit 2 has an image detecting section 72 provided along the conveyance path of the sheet S.

The relay unit 2 has a certain distance for conveyance in order to cool the sheets S heated and fixed by the body unit 1 or to correct the curling. Accordingly, the relay unit 2 has a greater spatial allowance than the body unit 1. When an image detecting section 72 is provided on the relay unit 2 side, it is possible to minimize the upsizing of the body unit 1, as compared to the case where the image detecting section 72 is provided on the body unit 1, and to make an effective use of the unwanted space.

According to the present embodiment, the pattern image is a multiple tone pattern image whose density undergoes stepwise changes in the sheet conveyance direction. The main control section 40 corrects the image density conditions based on the result of detecting the pattern image by the image detecting section 72. This structure provides an effective correction of the image density conditions by using a multiple tone pattern image.

According to the present embodiment, when deviation correction is not performed, the image forming control section 46 does not offset the image forming position, independently of the result of detection by the deviation sensor 45. Alternatively, when deviation is not corrected, the image forming control section 46 does not allow the deviation sensor 45 to detect the conveyance position for the sheet S on which a pattern image is to be formed. According to such a technique, the deviation correction for the conveyed sheet S can be prevented. This arrangement ensures effective detection of each of the pattern images Spy through Spk by each of the color sensors 72Y through 72K.

According to the present embodiment, since each of a plurality of image forming units forms one pattern image at mutually difference positions, the pattern image is made up of a plurality of pattern images Spy through Spk of different colors across the width of the sheet. In this case, the image detecting section 72 is composed of a plurality of color sensors 72Y through 72K corresponding to the image forming units, respectively. According to the present embodiment, each of image density conditions for each color element of the color image forming apparatus can be corrected. This enhances the reproducibility of the image to be formed.

Further, in the present embodiment, a plurality of color sensors 72Y through 72K are arranged close to one another across the width of the sheet in such a way that a plurality of pattern images having different colors can be formed on the sheet of a prescribed small size out of a plurality of sheet sizes for which an image can be formed by the image forming section.

For example, even if the sheet S is deviated, if it is intended to establish the positional correspondence between pattern images Spy through Spk and color sensors 72Y through 72K, the following technique can be used. To put it more specifically, a sufficient width of each of the pattern images Spy through Spk and a wide space intervals among the pattern images Spy through Spk are set, and color sensors 72Y through 72K are arranged correspondingly. Since this structure provides a sufficient width of each of the pattern images Spy through Spk, even if the sheet S is deviated, each of the pattern images Spy through Spk passes below the each of the color sensors 72Y through 72K. Thus, the pattern images Spy through Spk can be detected by the color sensors 72Y through 72, respectively.

However, this technique increases the dimension across the width of the sheet, of the entire pattern formed by the pattern images Spy through Spk. Thus, formation of the pattern images will require a sheet S of greater size to some extent. Further, arrangement of color sensors will also require a wider space. According to the present embodiment, pattern images are formed close to one another across the width of the sheet. Further, a plurality of color sensors 72Y through 72K are arranged close to one another across the width of the sheet. This method enhances economic advantages and versatility of the relay unit 2.

The image forming apparatus have been described with reference to the embodiments of the present invention. It goes without saying that the present invention is not restricted thereto. The present invention can be embodied in a great number of variations without departing from the scope of the invention claimed.

For example, in the aforementioned embodiment, the image forming apparatus is made up of the body unit 1 and relay unit 2. However, even if the image forming apparatus is formed of the body unit 1 alone, the image forming apparatus can function as part of the present invention. To be more specific, the image forming apparatus does not always require the image detecting section 72 attached as its component element. In the present embodiment, the relay unit 2 is equipped with an image detecting section 72. It is also possible to arrange such a configuration that the body unit 1 is equipped with an image detecting section 72, and the image formed on the sheet S is detected on the sheet conveyance path where the sheet S with an image formed thereon by the image forming section is conveyed.

In the aforementioned embodiment, the image forming apparatus can be provided with a body unit 1 and post-processing apparatus. In this case, the post-processing apparatus is provided with the image detecting section 72, whereby the same advantages as those in the aforementioned embodiment can be obtained. Thus, an apparatus connected to the body unit 1 can be either the relay unit 2 or post-processing apparatus. Accordingly, the relay unit 2 and post-processing apparatus are collectively called a sheet conveying device.

Further, the aforementioned embodiment has been described with reference to the example where the pattern images Spy, Spm, Spc and Spk of four single colors are used as pattern images. However, the present invention need not be restricted thereto. For example, a barcode, register mark image or any other image that requires detection by the image detecting section 72 can be used.

Further, use of the color image forming apparatus was assumed in the above description of the embodiment. Without being restricted thereto, the present invention is also applicable to the image forming apparatus of the monochromatic system. In the description of the aforementioned embodiment, use of the image forming apparatus based on electrophotographic process was assumed. Without being restricted thereto, the present invention is also applicable to the image forming apparatus of different system such as an inkjet system.

According to the embodiment of the present invention, the image control section does not correct the deviation when a pattern image is formed on a sheet. Accordingly, a pattern image forming position is not changed even if the sheet is deviated. This allows positional correspondence to be established between the pattern image and image detecting section, and ensures the pattern image to be accurately detected by the image detecting section.

What is claimed is:

1. An image forming apparatus comprising:

an image forming section configured to form an input image corresponding to image data which has been input or a pattern image corresponding to pattern data stored in advance on a sheet which is conveyed to the image forming section;

a control section configured to control at least the image forming section; and a position detecting section configured to detect position of the sheet in a width direction of the sheet perpendicular to a sheet conveyance direction before the input image or the pattern image is formed on the sheet by the image forming section, wherein on a prescribed condition, the control section controls the image forming section so as to form the pattern image at an image forming position which has been set in advance and which is located at a position corresponding to a position of an image detecting section configured to detect the pattern image formed on the sheet, wherein when the image forming section forms the input image on the sheet, the control section performs a deviation correction to change the image forming position of the input image in the width direction of the sheet according to a result of detection by the position detecting section; and wherein when the image forming section forms the pattern image on the sheet, the control section does not perform the deviation correction.

2. The image forming apparatus of claim 1, wherein when the control section does not perform the deviation correction, the control section does not offset the image forming position, regardless of the result of detection by the position detecting section.

3. The image forming apparatus of claim 1, wherein when the control section does not perform the deviation correction, the control section does not permit the position detecting section to detect the position of the sheet as a target of formation of the pattern image.

4. The image forming apparatus of claim 1, further comprising:

wherein the pattern image is a multiple tone pattern image in which an image density changes gradually in the conveyance direction of the sheet, and wherein the image detecting section detects a density of the image formed on the sheet and the control section corrects an image density of the image forming section based on a result of detecting of the multiple tone pattern image by the image detecting section.

5. The image forming apparatus of claim 1, wherein the image forming section comprises a plurality of image forming units for forming a color image by superimposition of images having different colors, wherein the pattern image includes a plurality of pattern images of different colors across the width of the sheet formed by each of the plurality of image forming units at a different position, and wherein the image detecting section includes a plurality of image detecting units respectively corresponding to the plurality of pattern images.

6. The image forming apparatus of claim 5, wherein, the plurality of image detecting units are arranged close to one another across the width of the sheet such that the plurality of pattern images can be formed even on a sheet of a prescribed small size out of a plurality of sizes of sheets on which the image forming section can form an image.

7. The image forming apparatus of claim 1, wherein when the control section performs the deviation correction, the control section calculates the deviation amount of the sheet in the width direction of the sheet based on the result of detection by the position detection section, and controls the image forming section so as to change the image forming position in the width direction of the sheet according to the calculated deviation amount.

8. The image forming apparatus of claim 7, wherein the control section calculates the deviation amount of the sheet in the width direction of the sheet based on the actual position of the sheet detected by the position detecting section and the position of the sheet in a standard position of the sheet.

9. The image forming apparatus of claim 1, wherein when the control section performs the deviation correction, the control section changes exposure position on a photoreceptor drum according to the result of detection by the position detecting section.

10. The image forming apparatus of claim 1, wherein the image detecting section is mounted on the image forming apparatus in a prescribed position in the width direction of the sheet.

11. The image forming apparatus of claim 1, comprising;

a body comprising at least the image forming section and the image detecting section configured to detect the pattern image formed by the image forming section in a conveyance path of the sheet, and a sheet conveying device configured to convey a sheet having an image formed thereon by the image forming section.

12. The image forming apparatus of claim 1, comprising;

a body which comprises at least the image forming section, and a sheet conveying device configured to convey a sheet having an image formed thereon by the image forming section and which includes at least the image detecting section configured to detect the pattern image formed by the image forming section in a conveyance path of the sheet.

* * * * *